US005762484A

United States Patent [19]

Whitham

[11] Patent Number: 5,762,484

[45] Date of Patent: Jun. 9, 1998

[54] GEROTOR TYPE PUMP HAVING ITS OUTER ROTOR SHAPE DERIVED FROM THE INNER ROTOR TROCHOID

[75] Inventor: Gavin P. Whitham, East Hunsbury, England

[73] Assignee: T&N Technology Limited, Rugby, England

[21] Appl. No.: 737,643

[22] PCT Filed: Jun. 13, 1995

[86] PCT No.: PCT/GB95/01374

§ 371 Date: Oct. 21, 1996

§ 102(e) Date: Oct. 21, 1996

[87] PCT Pub. No.: WO96/01372

PCT Pub. Date: Jan. 18, 1996

[30] Foreign Application Priority Data

Jul. 2, 1994 [GB] United Kingdom ..... 9413337

[51] Int. Cl.[6] ..... F04C 2/10

[52] U.S. Cl. ..... 418/150; 418/171

[58] Field of Search ..... 418/150, 166, 418/171

[56] References Cited

U.S. PATENT DOCUMENTS 2,965,039 12/1960 Morita ..... 418/150
4,673,342 6/1987 Saegusa ..... 418/150

FOREIGN PATENT DOCUMENTS 0 079 156 5/1983 European Pat. Off. .
223257 10/1924 United Kingdom .

OTHER PUBLICATIONS

Hill, M.F., *Kinematics of Gerotors*, The Peter Reilly Co., Philadelphia, PA., 1927, pp. 31–38.

*Primary Examiner*—John J. Vrablik
*Attorney, Agent, or Firm*—Synnestvedt & Lechner

[57] ABSTRACT

The pump has an inner rotor bounded by an outer peripheral shape which is generated by moving a first circle around a first trochoid. The inner rotor is mounted for rotation about a first axis. The pump also has an outer rotor mounted for rotation about a second axis which is offset from the first axis. The outer rotor is bounded by an inner peripheral shape which is generated by moving a second circle around a second trochoid.

4 Claims, 3 Drawing Sheets

GEROTOR TYPE PUMP HAVING ITS OUTER ROTOR SHAPE DERIVED FROM THE INNER ROTOR TROCHOID

This invention is concerned with a Gerotor-type pump which may be used, for example, as an oil pump.

Gerotor-type pumps are well known and comprise an inner rotor provided with external teeth which is located within a hollow outer rotor which is provided internally with teeth meshing with the external teeth of the inner rotor. The outer rotor has one more tooth than the inner rotor and the inner rotor has an axis of rotation which is offset or eccentric with respect to an axis of rotation of the outer rotor. By this arrangement, rotation of one rotor causes the other rotor to rotate as it is driven by the intermeshing teeth. During rotation, due to the eccentricity of the axis of rotation, the intermeshing relationship of the teeth changes progressively forming chambers between the teeth which change in volume to create a pumping action.

The inner rotor of a Gerotor-type pump is designed according to a well-established method. In this method, starting with a circle of diameter A (the base circle), a circle of diameter B (the rolling circle) is rolled around the outside of the base circle while tracing the track of a point at a distance e (the eccentricity) from the centre of the rolling circle. This gives a curve called a trochoid. It is necessary that the rolling circle rolls around the base circle an exact number of times. The ratio of the diameters A to B is the number of "teeth" (n) on the inner rotor.

Next, in designing the inner rotor, a circle of diameter C (the locus or track circle) is moved around the aforementioned trochoid with the centre of the circle on the trochoid. The track of the radially innermost point on the locus circle is the shape of the inner rotor.

Hitherto, the outer rotor of a pump of the Gerotor-type has been designed by drawing a circle of radius R. R is defined by (A+B) divided by 2 plus an adjustment for clearance. Next, n plus 1 centres are defined equally distributed around the circle of radius R. Each of these centres represents the centre of a tooth of the outer rotor. About these centres, circular arcs of radius r are drawn facing towards the centre of the circle of radius R. The radius of the arcs r is defined by C divided by 2 minus an adjustment for clearance. The design of a rotor of conventional type is shown in FIG. 1. In this case, the inner rotor has 5 teeth and the outer rotor has 6 arcuate teeth. As can be seen from FIG. 1, the teeth of the outer rotor are joined by arcs S of a circle, (centred at the centre of the circle of radius R).

The invention provides a pump of the gerotor type comprising an inner rotor and an outer rotor, the inner rotor being located within the outer rotor and being mounted for rotation about a first axis and the outer rotor being mounted for rotation about a second axis which is off-set from said first axis by an eccentricity of the pump, the inner rotor having an outer surface which has a toothed shape and is meshed with an inner surface of the outer rotor which has a toothed shape which has one more tooth than the inner rotor, said toothed shape of the inner rotor being a shape which is generated by moving a first circle around a trochoid with the centre of the circle on the trochoid, characterised in that said toothed shape of the outer rotor has a shape which is generated by moving a second circle around the envelope of the rotated inner rotor trochoid with the centre of the circle on the envelope.

A pump according to the invention operates more smoothly than conventional pumps giving quieter operation and longer life. The pump also has a more efficient pumping action.

Preferably, in a pump according to the invention, said first and second circles have diameters which differ by a predetermined operating clearance between the rotors.

There now follows a detailed description, to be read with reference to the accompanying drawings, of a pump which is illustrative of the invention and of an illustrative method by which shapes of the rotors of the illustrative pump are generated.

Figure 1:
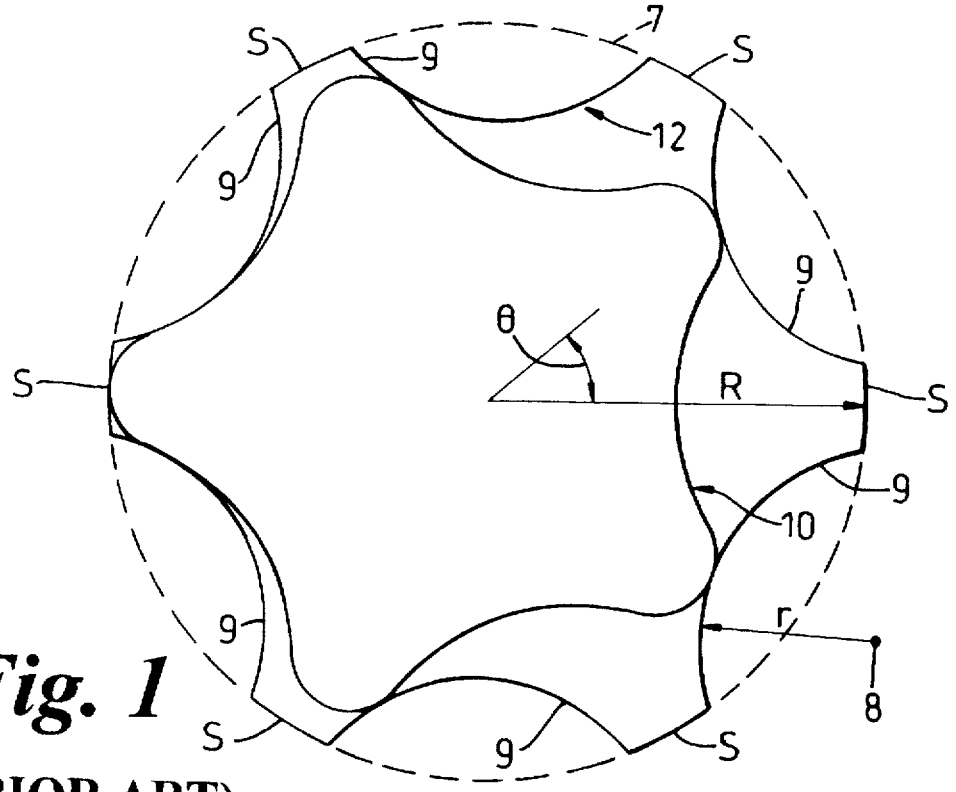
Fig. 1 (PRIOR ART)
FIG. 1 is a diagrammatic representation of the outer peripheral shape of an inner rotor and the inner peripheral shape of an outer rotor of a conventional pump of the gerotor type, showing the rotors meshed.

The conventional pump shown in FIG. 1 comprises an inner rotor bounded by an outer peripheral shape 10 and an outer rotor bounded by an inner peripheral shape 12. The illustrative pump shown in FIG. 2 comprises an inner rotor bounded by an outer peripheral shape 20 and an outer rotor bounded by an inner peripheral shape 22. The shapes 10 and 20 are identical but the shapes 12 and 22 are different.

Both inner rotor shapes 10 and 20 are generated by the same well established method referred to above and described now in detail for rotor shape 20.

Figure 3:
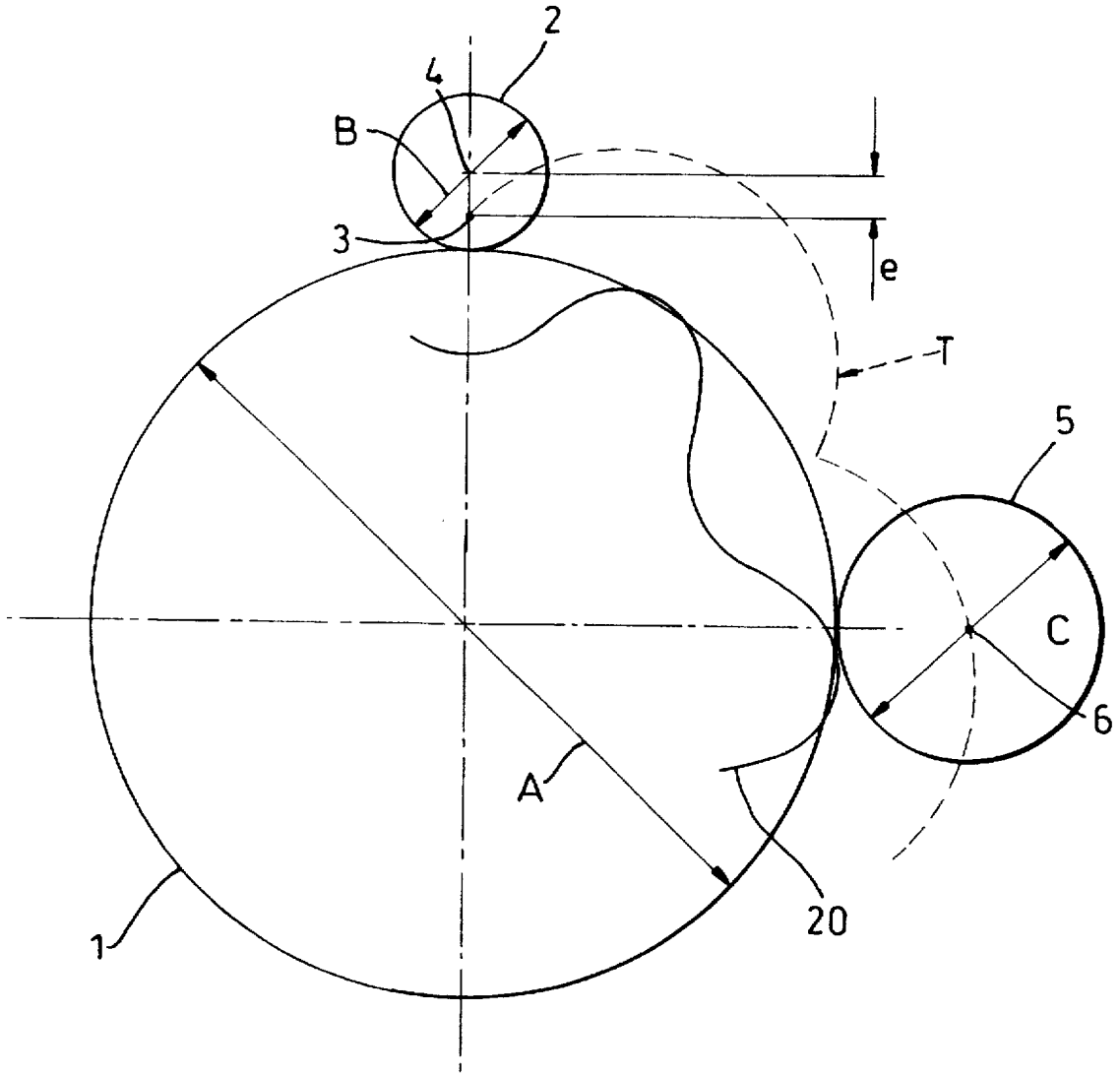
FIG. 3 is a diagrammatic view illustrating the generation of the outer peripheral shape of an inner rotor of a conventional pump of the gerotor type.

As depicted in FIG. 3, a base circle 1 having diameter A is first established. A rolling circle 2 having diameter B is rolled around the outside of the base circle 1 while tracing the track T of a point 3 positioned at a distance e from the center 4 of rolling circle 2. Distance e is called the eccentricity and track T forms a curve called a trochoid. The diameters A and B are related such that rolling circle 2 rolls around base circle 1 an exact whole number of times, the ratio of the diameter A to B being equal to n, the number of teeth on the inner rotor.

Next the track circle 5 having a diameter C is moved around track T with the center 6 of track circle 5 on track T. The inner rotor shape 20 is defined as the locus of points radially innermost on track circle 5 as it moves around track T.

FIG. 1 illustrates how the prior art outer rotor shape 12 is determined. A circle 7 (shown in dashed lines) having radius R is established. Radius R equals half the sum of radii A and B plus a small amount for rotor clearance. Next n+1 centers 8 are defined at positions equidistant around circle 7, only one of which is expressly shown. Recall that n equals the number of teeth in the inner rotor and the outer rotor has one more tooth (n+1) than the inner rotor. Centers 8 thus represent centers of teeth of the outer rotor. About each center 8 a respective circular arc 9 having radius r is drawn. Each of the arcs 9 face towards the center of circle 7. Radius r equals half of the diameter C of track circle 5 (see FIG. 3) minus a small amount for rotor clearance. Arcs 9 are joined by arcs S formed by segments of the circle 7 of radius R.

Figure 4:
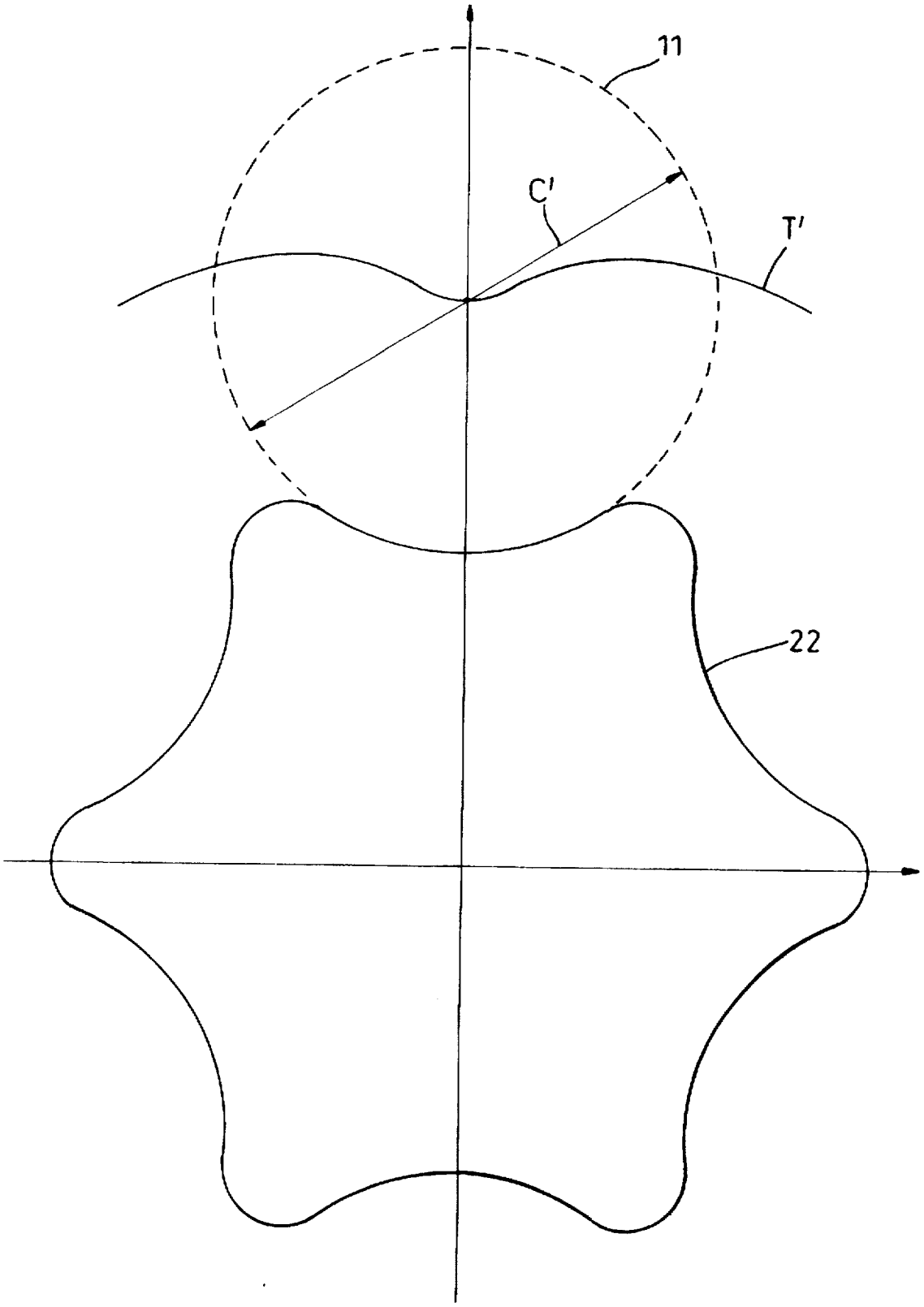
FIG. 4 is a diagrammatic view illustrating the generation of the inner peripheral shape of an outer rotor of a pump of the gerotor type according to the invention.

FIG. 4 illustrates how outer-rotor shape 22 is derived according to the invention. As described above, Track T is formed by rolling circle 2 rolling around base circle 1 and tracing the trochoid path of eccentric point 3 (shown in FIG. 1). Track T is then rotated about its own center while the rotating track T is simultaneously rotated about a center point about which the outer rotor shape will be formed.

During the rotation of track T simultaneously about both centers, the position of the point furthest from the outer rotor shape's center is plotted to form track T', as shown in FIG. 4. Track T' thus formed, therefore, comprises the envelope of the track T. Next a second track circle 11 having a diameter C' different from C is moved around track envelope T' with the center 13 of second track circle 11 following track envelope T'. Diameters C and C' differ by an amount which represents a predetermined operating clearance between the inner and outer rotors, with diameter C being relatively larger than diameter C' in proportion to the desired operating clearance. The outer rotor shape 22 is defined as the locus of points radially innermost on second track circle 11 as it moves around track envelope T'.

The inner and outer rotor shapes 20 and 22 can be described with greater precision by the series of parametric equations derived below.

The coordinates of a point on the trochoid generated by a point distance e from the centre of the rolling circle as it is rolled around the base circle are given by Equations 1 and 2 where θ is the angle subtended at the origin.

EQUATION 1

$$x={}_2^B(n+1)\cos(\theta)-e\cos((n+1)\theta)$$

EQUATION 2

$$y={}_2^B(n+1)\sin(\theta)-e\sin((n+1)\theta)$$

The coordinates of the shapes 10 and 20 are then given by X and Y in Equation 3.

EQUATION 3

$$(X-x)^2+(Y-y)^2=({}_2^C)^2$$

Differentiating Equation 3 with respect to θ gives Equation 4.

EQUATION 4

$$(X-x)_{\delta\theta}^{\delta x}+(Y-y)_{\delta\theta}^{\delta y}=0$$

Rearranging Equation 4 and substituting in K as defined in Equation 6 gives Equation 5.

EQUATION 5

$$(Y-y)=-K(X-x)$$

EQUATION 6

$$K=\frac{\frac{\delta x}{\delta\theta}}{\frac{\delta y}{\delta\theta}}$$

Differentiation of Equations 1 and 2 and substitution into Equation 5 gives Equation 7.

EQUATION 7

$$K=\frac{-\frac{B}{2}\sin(\theta)+e\sin((n+1)\theta)}{\frac{B}{2}\cos(\theta)-e\cos((n+1)\theta)}$$

Substituting Equation 5 into Equation 3 and solving gives Equations 8 and 9 whose innermost points define the coordinates of points on the shapes 10 and 20.

EQUATION 8

$$X=x\pm\frac{C}{2\sqrt{1+K^2}}$$

EQUATION 9

$$Y=y\mp\frac{CK}{2\sqrt{1+K^2}}$$

Figure 2:
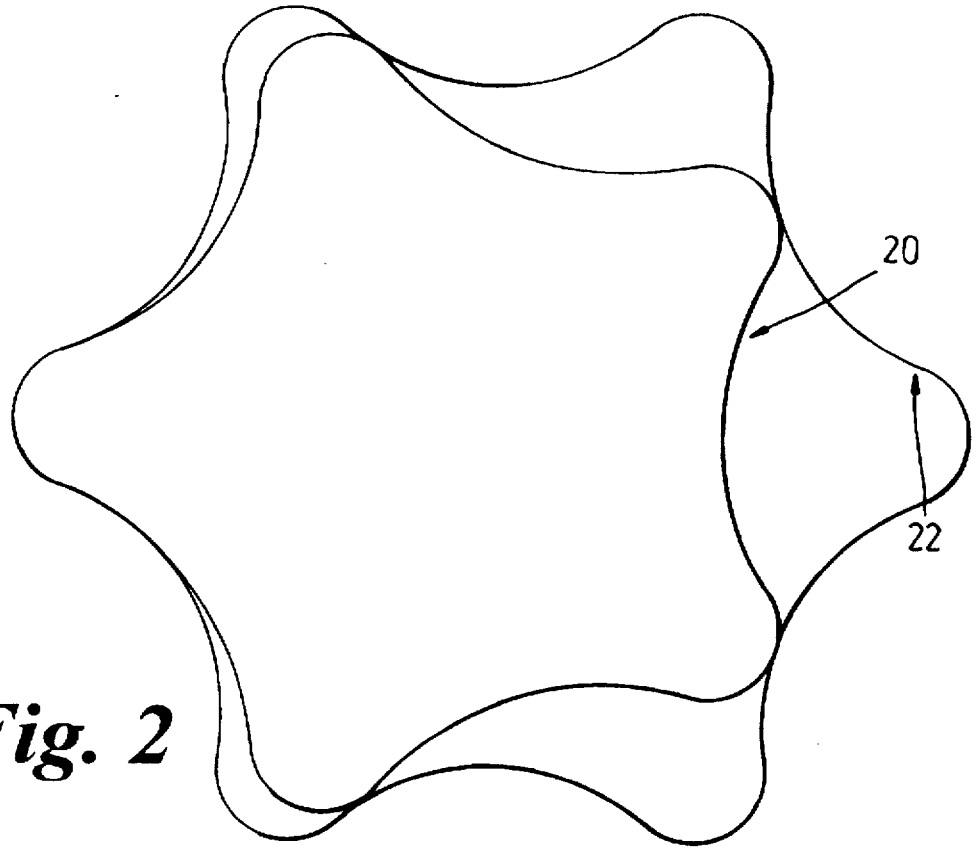
FIG. 2 is similar to FIG. 1 but shows the illustrative pump on a larger scale.

From FIGS. 1 and 2, it can be seen that the shapes 10 and 20 are toothed with five generally-arcuate teeth joined by convex arcs.

The shape 12 of the outer rotor of the conventional pump shown in FIG. 1 is generated by drawing six (n+1) arcs on a circle of radius R (equal to A+B divided by 2), each arc having a radius of C divided by 2 minus a clearance.

The shape 22 of the inner peripheral surface of the outer rotor of the illustrative pump is, however, generated from the envelope whose coordinates are defined as the envelope of the rotated inner rotor trochoid and by Equations 10 and 11 in which R is defined by Equation 12, z is defined by Equation 13 and the angle v takes the values defined by Equation 14.

EQUATION 10

$$x=R\cos(2v)-\frac{ze^2}{R}\sin(2zv)\sin(2v)\pm 2e\sqrt{1-\left(\frac{ze}{R}\right)^2\sin^2(zv)}\cos(2v)\cos(zv)$$

EQUATION 11

$$y=R\sin(2v)+\frac{ze^2}{R}\sin(2zv)\cos(2v)\pm 2e\sqrt{1-\left(\frac{ze}{R}\right)^2\sin^2(zv)}\sin(2v)\cos(zv)$$

EQUATION 12

$$R={}_2^1(A+B)$$

EQUATION 13

$$z=(n+1)$$

EQUATION 14

$$v=\frac{\pi}{6}\ldots\frac{\pi}{2},\frac{5\pi}{6}\ldots\frac{7\pi}{6},\frac{3\pi}{2}\ldots\frac{11\pi}{6}$$

In order to generate the shape 22 from the envelope defined by Equations 10 and 11, Equations 6, 8 and 9 are used with θ replaced by v and with C equal to the diameter of the track circle minus a small clearance. K is determined by differentiating Equations 10 and 11 with respect to v to give Equations 15 and 16 which define K according to Equation 17. The coordinates of the shape 22 are then given by the innermost points of Equations 8 and 9, where x, y and K are given by Equations 10, 11 and 15 to 17.

EQUATION 15

$$K_A=-\left[2R\sin(2v)+2\frac{(ze)^2}{R}\cos(2zv)\sin(2v)+2\frac{ze^2}{R}\sin(2zv)\cos(2v)\pm 2e\sqrt{1-\left(\frac{ze}{R}\right)^2\sin^2(zv)}\left[\frac{z^3\left(\frac{e}{R}\right)^2\sin(zv)\cos(2v)\cos^2(zv)}{1-\left(\frac{ze}{R}\right)^2\sin^2(zv)}+2\sin(2v)\cos(zv)+z\cos(2v)\sin(zv)\right]\right]$$

EQUATION 16

$$K_B=2R\cos(2v)+2\frac{(ze)^2}{R}\cos(2zv)\cos(2v)-2\frac{ze^2}{R}\sin(2zv)\sin(2v)\pm 2e\sqrt{1-\left(\frac{ze}{R}\right)^2\sin^2(zv)}\left[-\frac{z^3\left(\frac{e}{R}\right)^2\sin(zv)\sin(2v)\cos^2(zv)}{1-\left(\frac{ze}{R}\right)^2\sin^2(zv)}+2\cos(2v)\cos(zv)+z\sin(2v)\sin(zv)\right]$$

EQUATION 17

$$K=\frac{K_A}{K_B}$$

I claim:

1. A pump of the gerotor type comprising an inner rotor and an outer rotor, the inner rotor being located within the outer rotor and being mounted for rotation about a first axis and the outer rotor being mounted for rotation about a second axis which is offset from said first axis by an eccentricity of the pump, the inner rotor having an outer surface which has a toothed shape and is meshed with an inner surface of the outer rotor which has a toothed shape which has one more tooth than the inner rotor, said toothed shape of the inner rotor being a shape which is generated by moving a first circle around a trochoid with the centre of the circle on the trochoid, characterised in that said toothed shape of the outer rotor has a shape which is generated by moving a second circle around the envelope of the rotated inner rotor trochoid when the inner rotor trochoid is rotated about a center about which the outer rotor shape will be formed with the centre of the second circle on the envelope, the diameter of said first and second circles differing by a predetermined small clearance.

2. A pump according to claim 1, characterised in that said first and second circles have diameters which differ by a predetermined operating clearance between the rotors.

3. A pump according to claim 1, characterised in that said envelope has a shape given by

EQUATION 10

$$x=R\cos(2v)-\frac{ze^2}{R}\sin(2zv)\sin(2v)\pm 2e\sqrt{1-\left(\frac{ze}{R}\right)^2\sin^2(zv)}\cos(2v)\cos(zv)$$

EQUATION 11

$$y=R\sin(2v)+\frac{ze^2}{R}\sin(2zv)\cos(2v)\pm 2e\sqrt{1-\left(\frac{ze}{R}\right)^2\sin^2(zv)}\sin(2v)\cos(zv)$$

4. A pump according to claim 3, characterised in that the toothed shape of the outer rotor is given by

EQUATION 8

$$X=x\pm\frac{C}{2\sqrt{1+K^2}}$$

EQUATION 9

$$Y=y\mp\frac{CK}{2\sqrt{1+K^2}}$$

EQUATION 10

$$x=R\cos(2v)-\frac{ze^2}{R}\sin(2zv)\sin(2v)\pm 2e\sqrt{1-\left(\frac{ze}{R}\right)^2\sin^2(zv)}\cos(2v)\cos(zv)$$

EQUATION 11

$$y=R\sin(2v)+\frac{ze^2}{R}\sin(2zv)\cos(2v)\pm 2e\sqrt{1-\left(\frac{ze}{R}\right)^2\sin^2(zv)}\sin(2v)\cos(zv)$$

EQUATION 15

$$K_A = -\left[ 2R\sin(2\nu) + 2\frac{(ze)^2}{R}\cos(2z\nu)\sin(2\nu) + 2\frac{ze^2}{R}\sin(2z\nu)\cos(2\nu) \pm 2e\sqrt{1-\left(\frac{ze}{R}\right)^2\sin^2(z\nu)}\left[\frac{z^3\left(\frac{e}{R}\right)^2\sin(z\nu)\cos(2\nu)\cos^2(z\nu)}{1-\left(\frac{ze}{R}\right)^2\sin^2(z\nu)} + 2\sin(2\nu)\cos(z\nu) + z\cos(2\nu)\sin(z\nu)\right]\right]$$

EQUATION 16

$$K_B = 2R\cos(2\nu) + 2\frac{(ze)^2}{R}\cos(2z\nu)\cos(2\nu) - 2\frac{ze^2}{R}\sin(2z\nu)\sin(2\nu) \pm 2e\sqrt{1-\left(\frac{ze}{R}\right)^2\sin^2(z\nu)}\left[-\frac{z^3\left(\frac{e}{R}\right)^2\sin(z\nu)\sin(2\nu)\cos^2(z\nu)}{1-\left(\frac{ze}{R}\right)^2\sin^2(z\nu)} + 2\cos(2\nu)\cos(z\nu) - z\sin(2\nu)\sin(z\nu)\right]$$

EQUATION 17

$$K = \kappa_B^{\kappa_A}.$$

* * * * *